United States Patent [19]

Johnson, Jr. et al.

[11] Patent Number: 4,962,625

[45] Date of Patent: Oct. 16, 1990

[54] CONTAINER PACKING MACHINES

[75] Inventors: A. David Johnson, Jr.; Joseph L. Bachman, Jr., both of Wayne, Pa.

[73] Assignee: Wayne Automation Corporation, Norristown, Pa.

[21] Appl. No.: 362,310

[22] Filed: Jun. 6, 1989

Related U.S. Application Data

[63] Continuation of Ser. No. 272,930, Nov. 18, 1988, abandoned, which is a continuation of Ser. No. 193,772, May 13, 1988, abandoned, which is a continuation of Ser. No. 43,614, Apr. 28, 1987, abandoned.

[51] Int. Cl.[5] ..... B65B 35/44; B65B 21/06

[52] U.S. Cl. ..... 53/157; 53/543; 53/263; 198/419.1

[58] Field of Search ..... 53/157, 543, 263, 246, 53/247; 198/425; 493/478

[56] References Cited

U.S. PATENT DOCUMENTS

| | | | |
|---|---|---|---|
| 3,406,493 | 10/1968 | Katogir | 53/48 |
| 3,430,413 | 3/1969 | Wood | 53/48 |
| 3,760,557 | 9/1973 | McIntyre | 53/543 |
| 4,642,967 | 2/1987 | Culpepper | 198/425 |

*Primary Examiner*—Horace M. Culver

*Attorney, Agent, or Firm*—Frederick J. Olsson

[57] ABSTRACT

In an integrated, continuous, container packing machine, where a constant supply of filled containers are moved along an axis and separated into discrete groups with each group fed to an insert station wherein a partition is inserted between containers of the group and then the group with the partition is fed to an operation to be placed or packed in a shipping medium, improvements which permit the machine to be rapidly changed for running a new batch of containers where the physical characteristics of the group and/or the physical characteristics of the containers in the group are different from the corresponding characteristics in the previously run batch.

3 Claims, 5 Drawing Sheets

CONTAINER PACKING MACHINES

This application is a continuation of application Ser. No. 272,930 filed Nov. 18, 1988 and now abandoned; which in turn is a continuation of Ser. No. 193,772 filed May 13, 1988 and now abandoned; which in turn is a continuation of application Ser. No. 043,614, filed Apr. 28, 1987 and now abandoned.

This invention relates in general to integrated, continuous, container packing machines, that is to say, a machine where a constant supply of filled containers are moved along an axis where they are separated into discreet groups and each group fed to an insert station where a partition means is inserted between containers of the group and then the group with the partition is fed to an operation to be placed or packed in a shipping medium such as a flap-type corrugated container or a tray with a shrink wrap-around or the like.

More specifically, the invention relates to mechanisms for such machines which permit the machine to be rapidly changed for running a new batch of containers where the physical characteristics of the group and/or the physical characteristics of the containers in the group are different from the corresponding characteristics in the previously run batch.

Machines of the kind in question are completely automatic and produce the required shipping medium with containers at a far greater rate than can be done by manual or semi-automatic methods. This type of operation is required not only to service high-product demand, but importantly for economy purposes. It is conventional that such machines are run almost constantly through two and in many instances through three working shifts. It is uneconomical for such a machine to be down and this is not done except for necessary maintenance and repair.

The need for constant operation with essentially zero down time and the fact that it is necessary to run groups and/or containers of different physical characteristics creates problems which put production requirements and economy into conflict.

The principal problem in changing over such machines resides in setting the grouper belts and lane guides to be compatible with the type of container being introduced to the machine and also setting up the grouper pins to effect the separation of containers into groups. At the present time the foregoing requires a great deal of adjustment and requires the use of several mechanics.

Thus, when a producer has to run containers, say in three separate batches where the physical characteristics between batches are different, the common practice is to purchase three different single-purpose machines. In many cases, one machine may be operating while the others are idle. The foregoing is obviously costly.

The other alternative is to purchase a single machine and when a different batch is to be run, the machine is shut down and various of the components adjusted, tested in a run, and then readjusted. All of this may take one or two full production days to get the machine back up to desired efficiency. If the foregoing is done at night or on weekends or holidays, it entails double or triple overtime. Also, one is never certain that a batch or production run will end just at the optimum time to start a change over.

The present invention provides an economical solution to the change-over problem both from the standpoint of equipment purchase and most importantly from the standpoint of eliminating or reducing downtime. The invention provides for eliminating the purchase of multiple, single-purpose machines and the protracted adjustment scheme which are now presently in vogue. This is done by the use of modules wherein all the necessary location of lane guides, belts, and pins are fixed and which can be installed in or removed from a machine much like is done with a drawer.

There are several ways in which the foregoing is accomplished and these will be explained below in connection with the following drawings wherein.

Figure 1:
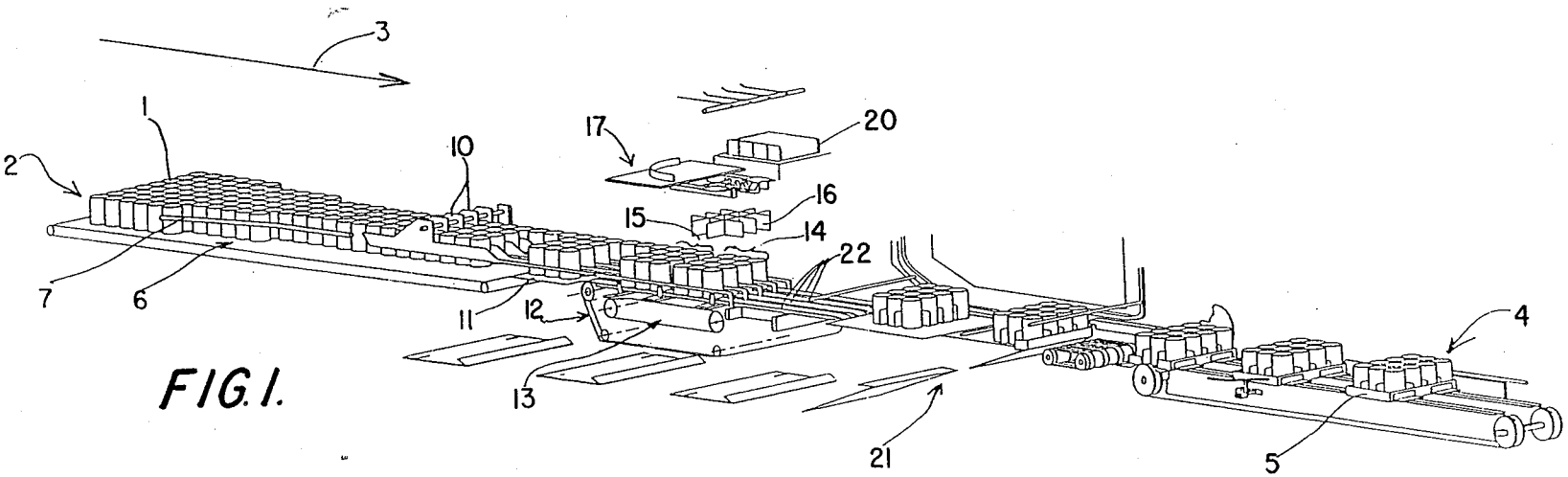
FIG. 1 is a perspective view depicting integrated-type equipment or a machine having the present invention installed within.
Figure 2:
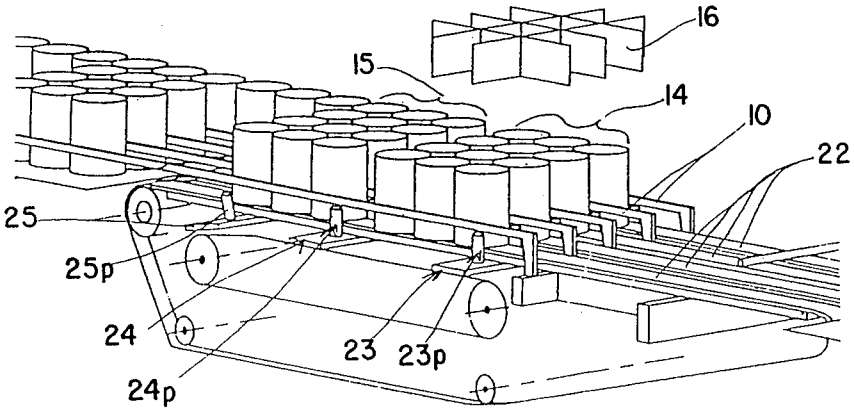
FIG. 2 is an enlarged fragmentary view of a portion of FIG. 1 emphasizing the present invention as arranged in the machine of FIG. 1.
Figure 3:
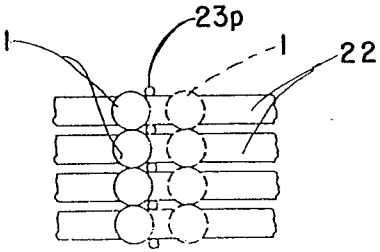
FIG. 3 is an enlarged fragmentary plan view illustrating containers and grouper belts and grouper pins inserted between rows of containers.

Another improvement in machines of the kind in question, namely a method of inserting partitions while the machine is running at high speed is shown in our copending application Ser. No. 923,100 filed Oct. 24, 1986 and entitled Method of Inserting Partitions. FIGS. 1, 2, and 3 herein are the same as the corresponding figures in said application. Referring now to FIGS. 1–3, the general nature of the kind of machine with which the invention is employed will be commented on.

In the machine as depicted in FIG. 1, a supply of individual containers 1 enter the end 2 of the machine and are moved along a horizontal axis in the direction of the arrow 3 to the end 4. In between the ends the containers are separated into groups and a partition is inserted between the containers of the groups which are then sent on to be placed in a shipping medium which in this case is a tray and then out the end 4 to inventory. The machine processes conventional containers made from glass, metal, paper, or plastic and filled with liquid, semi-liquid or dry powder product.

At the front end 2, the filled containers are received by the infeed conveyor 6. A pair of infeed guides, one of which is noted at 7, arranges the containers in a funnel shape and directs the same to the lane guide assembly 10. The assembly 10 arranges the containers in a plurality of lanes which are parallel to one another along the horizontal axis. From the infeed conveyor, the containers in the lanes are pushed to a dead plate 11. It is pointed out that in the representation shown, some of the containers have been omitted just to show the lane guides.

Forward of the dead plate is located a grouper belt conveyor assembly 12 which is removably mounted in the frame of the machine and removably mounted inside of this assembly is a grouper pin conveyor assembly 13. These assemblies are the claimed subject matter of this application as will be explained later. Just for ease of description, the grouper belt conveyor assembly will be referred to hereinafter as the belt assembly and the grouper pin conveyor assembly will be referred to hereinafter as the pin assembly.

The assemblies 12 and 13 form the containers into groups such as groups 14 and 15 and position the same to receive partition means such as the partition 16. In the embodiment depicted, the group 14 is in position to receive the partition means 16. A partition inserter mechanism is generally indicated at 17. The inserter mechanism takes folded partitions from a magazine 20, opens the same, and moves down for the insert operation.

The belt assembly 12 then delivers the group with inserted partition to the mechanism for placing the same in a shipping medium such as the tray 5. The tray blank feeding and folding mechanism is generally indicated at 21.

The above described arrangement is explained in somewhat more detail in the above mentioned copending application and reference may be had to that application for additional comments.

Before proceeding with the detailed description of the belt assembly and the pin assembly, we will comment on the operation of these assemblies 12 and 13 with respect to FIGS. 1, 2, and 3.

The belt assembly 12, removably mounted within the machine, has a plurality of belts 22 corresponding to the number of lanes formed by the lane guide means. The belts, of course, make a frictional engagement with the bottoms of the containers and move the same in the forward direction to position the groups under the insert mechanism 17 and then set up the group so that the same can be moved to the packing operation.

The pin assembly 13, removably mounted inside of the belt assembly 12, carries a plurality of sets of grouper pins. The sets as can be seen in FIGS. 1 and 2 are labeled 23, 24, and 25. The corresponding pins are labeled **23*p*, 24*p*, and 25*p***.

The grouper pins **23*p* of set 23 are on the forward side of the containers of group 14 and being engaged by the containers restrain motion of the group in the forward direction. It is preferable that each forward moving container be engaged by two grouper pins. Thus, with four containers in a transverse row, there are five grouper pins as is indicated in FIG. 3 at 23*p*. Also, as noted in FIG. 3, the inside grouper pins 23*p* are located between the belts 22** and the two outside pins are located adjacent the edges of the outside belts.

In the embodiment depicted, the pin assembly 13 carries five sets of grouper pins, two sets of which are not shown. The sets move in unison, around the assembly profile; i.e. along the top, around the forward end, backwards along the bottom, and thence around the trailing end to the top. When a set moves around the trailing end, the pins move upward between two adjacent rows of containers and function to separate the adjacent rows. This is indicated in FIG. 3 by the spaced-apart containers 1 in full and dotted lines. Thus, the engagement of adjacent, spaced-apart sets of grouper pins with the pins of each set between adjacent rows of containers forms the containers into separated groups. Note the separation of groups 14 and 15 in FIGS. 1 and 2.

As shown, the first group 14 comprises three containers in each lane and four containers in each row. The second group 15 has identically arranged containers. The group 14 is in a position for the insertion of a partition and the group 15 is ready to be moved into the insert position. A set of the grouper pins **23*p* moving from the top around the leading end of the pin assembly 13 will be disengaged from the containers (of the group 14) and this group will be moved by the belts 22** for delivery to the packing operation.

Figure 4:
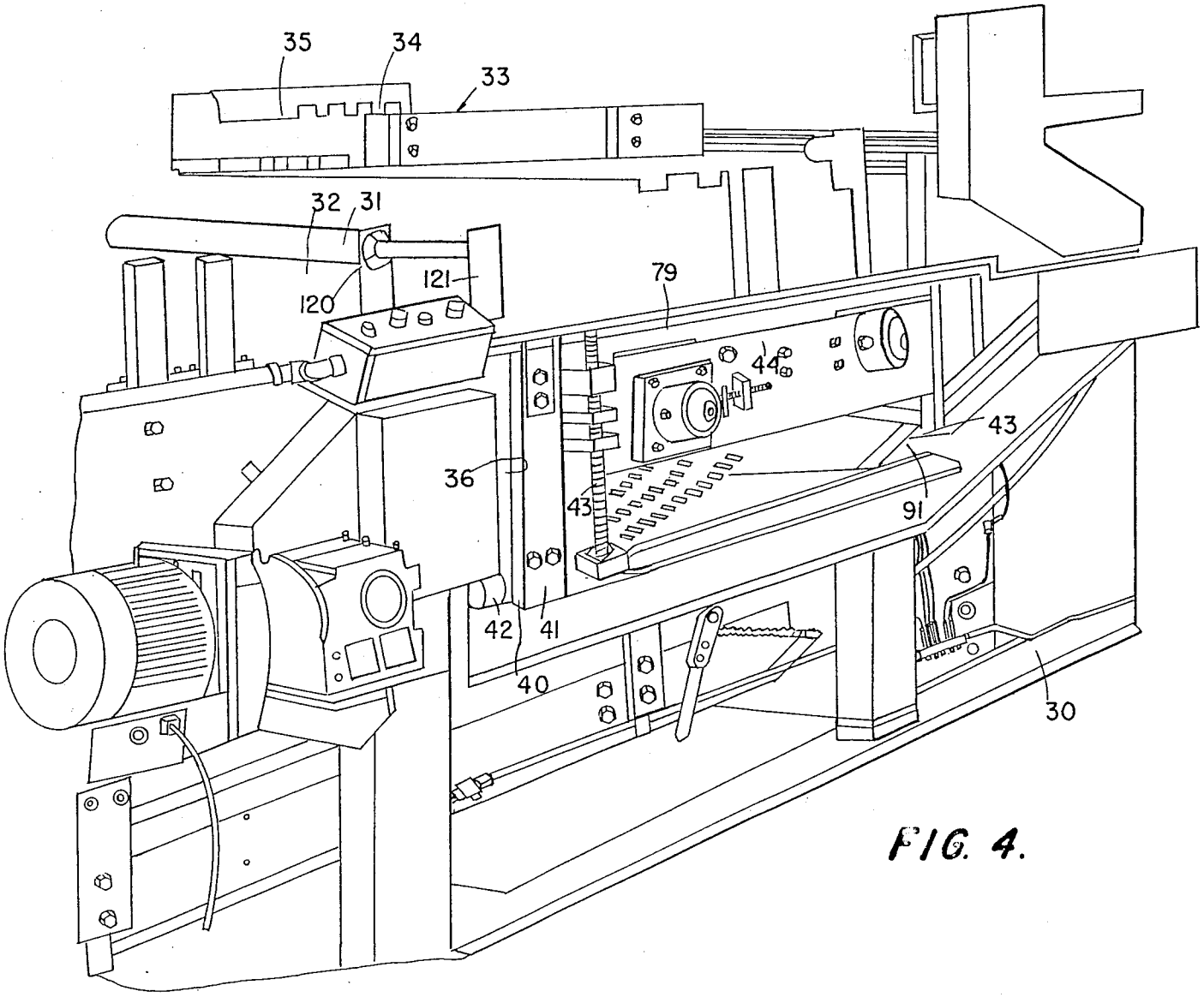
FIG. 4 is an elevational view of a small section of a machine of the kind as shown in FIG. 1 and illustrating the present as incorporated in the machine.

Turning now to the belt assembly and the pin assembly of FIGS. 4–7, a few items need to be pointed out. The assemblies of FIGS. 4–7 have a different number of belts and pins from the corresponding belts and pins in assemblies described above in connection with FIGS. 1 and 2. Also the lane guide assembly (as noted in FIG. 7) has a different structure than the lane guide assembly 10 of FIGS. 1 and 2. Both assemblies form lanes and, thus, are functionally the same. Reason for the foregoing differences will be apparent as the description proceeds. FIG. 4 is a fragmentary view of the front of a machine of the kind in question which incorporates the invention. The machine has a main frame 30 which supports the various means by which containers and groups of containers are moved along a horizontal axis. The lane guide assembly is indicated by dotted lines 31 and a small group of containers is indicated 32. The lane guide assembly 31 has line guides not shown in FIG. 4. The partition insert mechanism is indicated at 33. Like the insert mechanism 17 of FIG. 1, the insert mechanism extracts folded partitions 34 from a magazine 35, opens the partition, and inserts the same into a group of containers below.

The main frame 30 is structured to form a main frame opening 36 which extends through the machine from front to back. The frame 30 is provided with a pair of axially spaced-apart frame track means which also extend from front to back. In FIG. 4 one of the frame track means is indicated at 40.

Within the opening 36 is the belt assembly 41. This assembly 41 has rollers which cooperate with the frame track means to provide for the assembly to be rolled into and out of the opening. One of the rollers on the assembly 41 is indicated at 42. With the belt assembly 41 completely within the opening 36, the belts in the assembly are properly lined up with the lanes established by the lane guide assembly.

The belt assembly 41 is formed with an opening indicated at 43 and within this opening is disposed the pin assembly 44. As will be noted later on, the belt assembly 41 mounts roller means and the pin assembly 44 has track means which cooperate to provide for the pin assembly 44 to be rolled into and out of the opening 43.

When the pin assembly 44 is fully in the opening 43, the pins on the assembly are properly vertically aligned to perform the separating function. As will be noted later, the assembly 44 is elevated so that the pins slide up through the belts.

It will be evident that the machine shown in FIG. 4 has many more parts than those described above. Some of these parts will be referred to later. In any event, the above description of parts was made sufficient for one skilled in the art to understand the invention.

Figure 5:
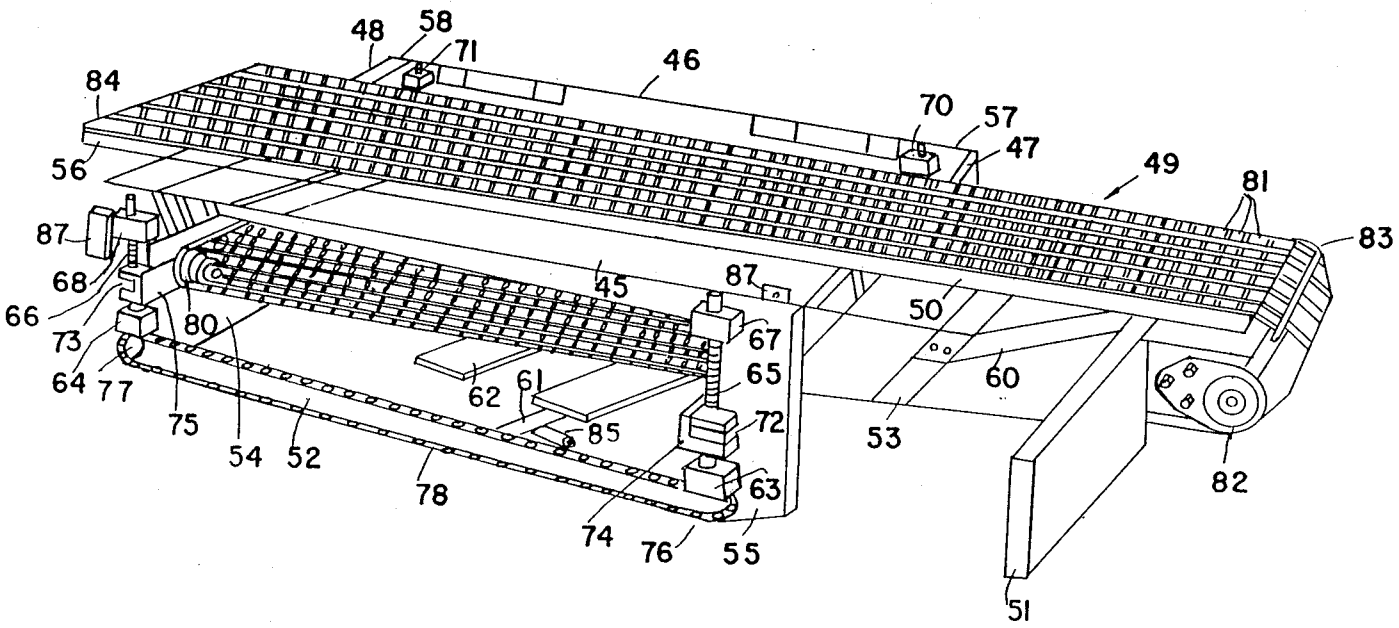
FIG. 5 is a perspective view of one form of grouper belt conveyer assembly of the invention.

Referring to FIG. 5, we will now describe the essential structure of the belt assembly 41.

The top section of the belt assembly 41 comprises the front top rail 45, rear top rail 46, top cross rails 47 and 48 an extension 49 having top legs one of which is noted at 50 and a top cross piece 51 which is connected to the legs of the extension.

The bottom section of the belt assembly 41 includes the front bottom rail 52, a rear bottom rail not shown, and bottom cross rails 53 and 54.

The front top rail 45 and the front bottom rail 52 are connected by front standards 55 and 56 and by rear standards 57 and 58.

A pair of braces 60 extend from the bottom cross rail 53 to the top cross piece 51.

Between the bottom front rail 52 and the bottom rear rail (not shown) are bottom transverse supports 61 and 62.

The front standard 58 carries a pair of upper and lower bearings 63 and the front standard 56 carries upper and lower bearings 64. The bearings 63 rotatably support the screws 65 and the bearings 64 rotatably support the screws 66. The lower bearings are the axial thrust type.

There are similar bearings on the rear standards 56 and 58, the upper bearings being noted at 67 and 68. These bearings on the rear standard support similar screws indicated at 70 and 71.

The screws 65 and 66 respectively carry nuts 72 and 73 and the screws 70 and 71 carry similar nuts not shown.

Secured to the nut 72 and to the corresponding nut on the screw 70 is a guide means 75 secured to the nut 73 and to the corresponding nut on screw 71 is a guide means 75. The guides 74 and 75 extend through the opening 43 front to back.

The screws 65 and 66 carry sprockets 76 and 77 on which is chain 78. The screws 70 and 71 carry similar sprockets and a chain not shown. The tops of screws 65, 66, 70, and 71 are squared off for purposes of accepting a ratchet winder. See the winder 79 on screw 66 in FIG. 4. Manipulation of the winder 79 rotates screws 66 and 65. A similar ratchet winder is used to rotate screws 70 and 71. Preferably, the ratchet winders on screws 66 and 71 are moved together. This causes the nuts 72 and 73 etc. to move up or down and carry the guides 75 and 76 up or down through the opening 43.

The guides 74 and 75 respectively carry pairs of rollers, one roller on guide 75 being indicated at 80.

As will be noted shortly, the pin assembly 44 rides on rollers secured to the guides 74 and 75 so the assembly can be easily rolled in and out. For insertion purposes, the guides 74 and 75 are moved all the way at the bottom. After the pin assembly 44 is all the way in the opening 43, the guides are raised until the pins on the pin assembly 44 reach the desired vertical position.

We will now describe the grouper belt arrangement on the belt assembly 41.

The belt assembly 41 carries six belts 81 which extend along the top of the belt assembly as shown. On the forward end of the belt assembly, the cross piece 51 mounts bearings 82 and 83 which rotatably support drive sprockets respectively carrying the belts 81. On the after end of the belt assembly 41, the cross rail 48 mounts a pair of bearings one of which is indicated at 84 which rotatably support idler sprockets also respectively carrying the belts 81. At the bottom of the belt assembly, the transverse supports 61 and 62 carry Teflon sliders or idlers with which the belts 81 are slideably engaged. The bottom cross rail 54 also carries a slider or idler ( not shown) over which the belts slide. The forward bearing 83 has a coupling (not shown) by which the same is connected to drive means. When the coupling is rotated the drive sprockets are rotated and this causes the desired belt motion.

The frame track means and the rollers by which the belt assembly 41 is moved in and out of the main frame opening 30 will now be noted in more detail. The transverse support 61 mounts a roller means one of which is noted at 85 in FIG. 5. As noted heretofore, one of the rollers of the other set is indicated at 42 in FIG. 1. Both sets of rollers run on track means on the frame and one of these track means was noted at 40 in FIG. 1.

The main frame 30 has stop means not shown to determine the innermost position of the assembly 41. When the assembly 41 is in position the straps 87 on the first and second standards 55 and 56 are bolted to the main frame 30.

Figure 6:
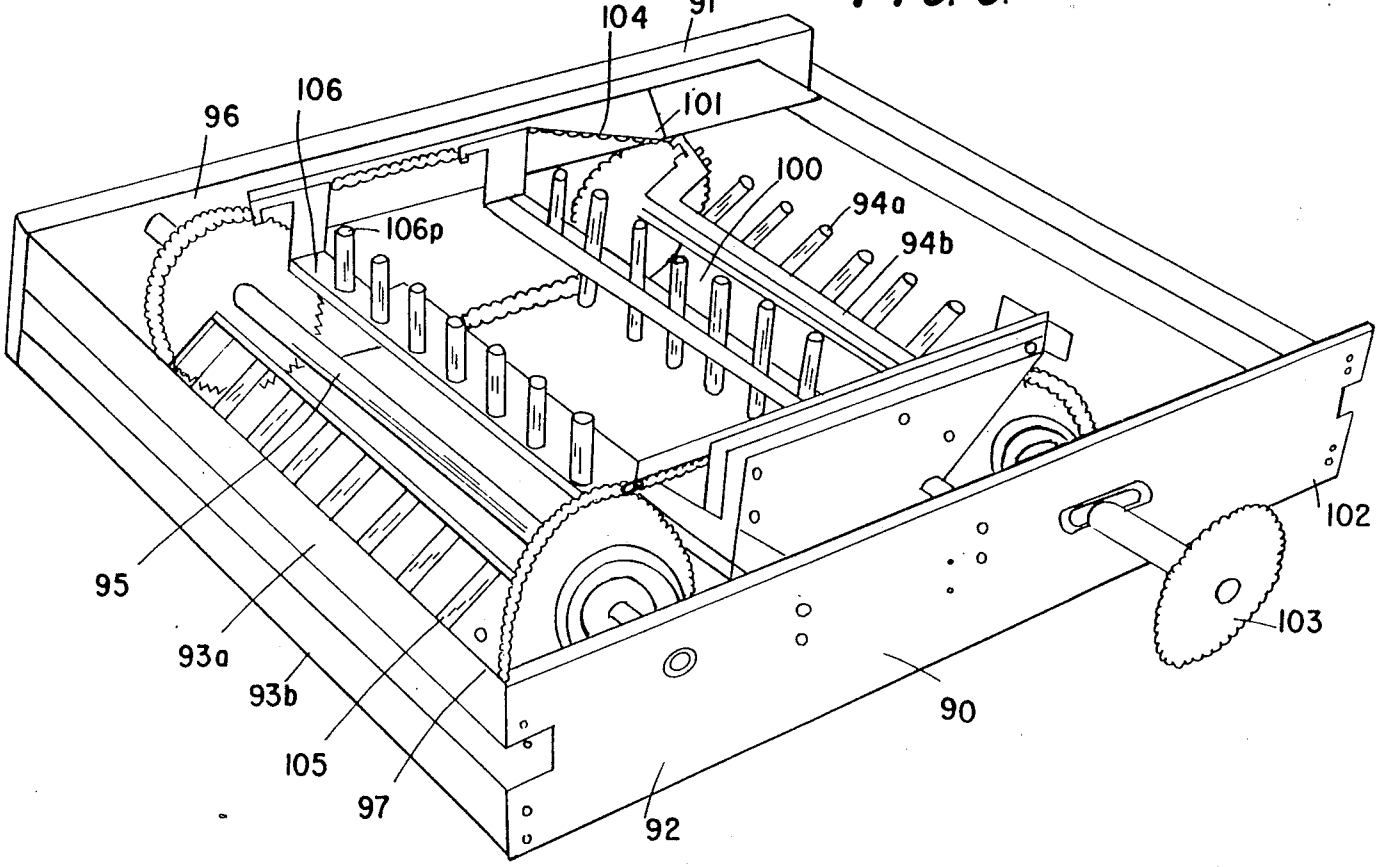
FIG. 6 is a perspective view of one form of the grouper pin conveyer assembly of the invention.

The pin assembly 44 will next be described in connection with FIG. 6.

The pin assembly 44 has a frame 90 comprising a front wall 91 (see also FIG. 1), a rear wall 92 and side walls 93 and 94. The side walls 93 and 94 respectively have upper and lower spaced-apart sections **93*a*–93*b* and 93*a*–94*b*. The spaced apart sections form track means which cooperate with the sets of rollers on the guide 74 and 75 on the belt assembly 41. The rear wall 92 is open at 92*a* and 92*b* for the track to receive the roller sets and the front wall 91 is closed and determines the innermost position. Nut and bolt assemblies (not shown) extending through the rear wall 92 and the rear top rail 46 hold the pin assembly 44** in position.

Between the walls 91 and 92 is a rotatably mounted shaft 95 to which are fixed the sprockets 96 and 97. Also between the walls 91 and 92 is a rotatably mounted shaft 100 to which are fixed sprockets 101 and 102.

The shaft 100 extends outwardly of the wall 92 and fixedly carries a drive sprocket 103. The sprockets 96 and 101 carry chain 104 and the sprockets 97 and 102 carry chain 105. It will be evident that when the sprocket 103 is rotated, the chains 104 and 105 will also be moved in unison.

The chains 104 and 105 carry a plurality of flight bars for example the flight bar 106 and 107 which respectively carry the grouper pins **106*p* and 107*p*. In the embodiment shown in FIG. 6, there are six flight bars each carrying 8** grouper pins.

As the chains 105 and 106 are moved, the flight bars and grouper pins are moved across the top, around one end, back across the bottom, and up around the opposite end. When adjacent flight bars are in the position of the flight bars 106 and 107, the grouper pins have positioned a group of containers for the partition insert operation.

The lane guide assembly 110 shown in FIG. 7 will next be explained.

In the lane guide assembly 110 there are a pair of threaded support rods 111 and 112, the respective ends of which have capture heads 113 and 114.

The support rods carry a plurality of lane guide plates 115 which are held in fixed spaced apart condition by the various spacers 116 and adjusting nuts 117. Obviously, more or fewer lane guide plates 115 can be mounted on the support bars 111 and 112. The spacers 116 are slotted so that they can be pushed on or pulled off of the rods.

The capture heads 113 and 114 are adapted to be dropped into slots on the top of posts mounted on opposite sides of the frame of the machine, for example, see the threaded support rod 120 and post 121 in FIG. 4. The assembly can be removed simply by pulling out of the slots.

The lane guide assembly 10 of FIG. 1 is depicted in a long unitary arrangement. The lane guide assembly 110 of FIG. 7 is depicted as a much shorter arrangement. Either type of arrangement may be employed. The arrangement in FIG. 7 has the advantage of being lighter in weight and easier to handle.

Figure 7:
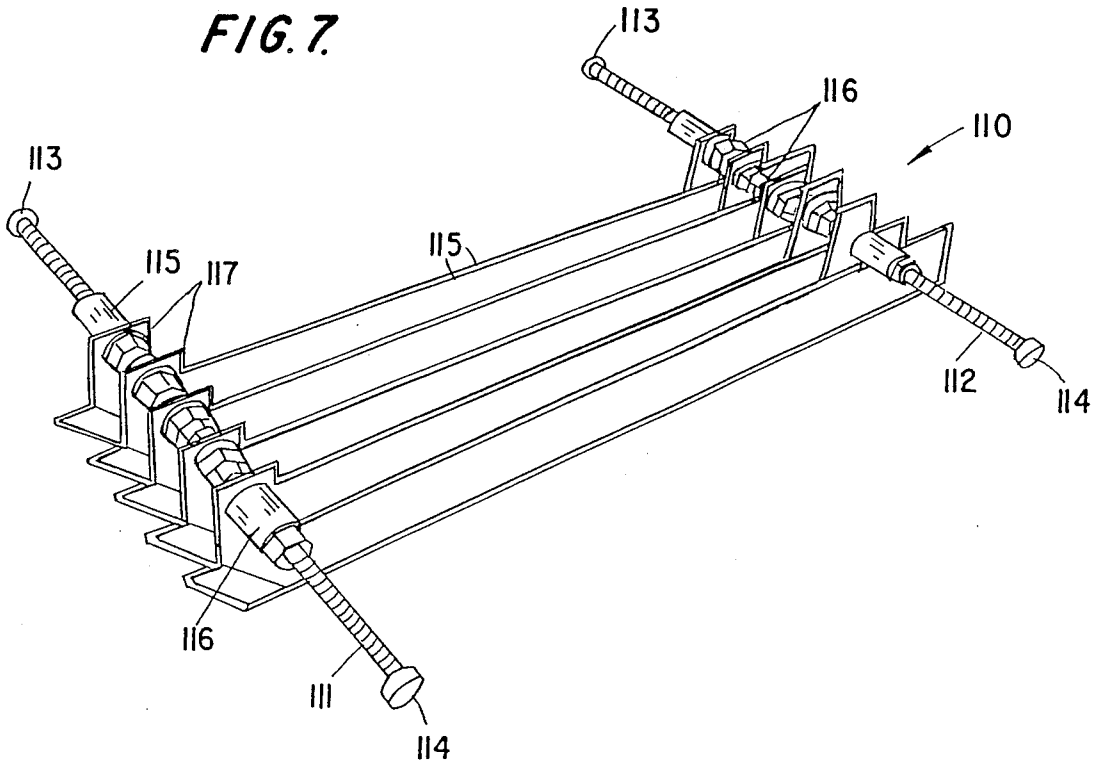
FIG. 7 is a perspective view of one form of lane guide means of the invention.

If the lane guide arrangement of FIG. 1 were converted to the arrangement of FIG. 7, three or four of the units of FIG. 7 would be set up end to-end along the axis of the machines. The machine of FIG. 4 employs the lane guide arrangement of FIG. 7.

We will now discuss various of the ways the invention is employed to achieve quick changeover.

Heretofore, we referred to the physical characteristic of groups of containers with relation to down time. These characteristics, of course, will be dependent upon the physical characteristics of the individual containers and upon the number of containers in the group. One important physical characteristic is the dimension in a direction normal to the machine axis. In a round container this will be the diameter, in square or rectangular containers (usually with rounded corners) the diameter will be the transverse width. In the material which follows it will be understood that the term diameter will encompass transverse widths.

In one form, the invention contemplates having a plurality of sets of alternatively useable sets of lane guide assemblies, belt assemblies, and pin assemblies. The lane spacing, belt spacing, pin spacing, and spacing between sets of pins are all fixed and with a known or predetermined combination of assemblies, containers of a desired size can be run through the machine. To run a batch of containers of a different physical characteristic from the containers of a batch previously run, it is only necessary to remove assemblies and replace by selected other assemblies.

A typical example will illustrate the employment of the foregoing concept and its advantage over conventional methods to effect changeover.

A producer production program may call for running batches of pint, quart, and half-gallon containers each of which has a different diameter. Under conventional methods, the producer would purchase three different machines or be faced with long shutdown for changeover. Proceeding under the concept of the invention, the producer purchases one machine with three lane guides assemblies, three belt assemblies, and three pin assemblies, the appropriate combination being used for the pints etc. The cost is approximately 35 percent of the cost of three machines. Moreover, there is a saving of costly down time.

In another aspect, the invention contemplates that the lane guide assembly and the belt assembly respectively have plates and belts of fixed spacing and that changeover be effected by employing different pin assemblies. In connection with this aspect, the invention contemplates designing the assemblies to have a maximum number of lanes and belts and the several pin assemblies to have the same number of pins, or fewer number of pins and sets with different spacing. Versatility is increased because the machine may be running containers of a given size and a changeover may require that more or fewer lanes and belts by employed and, to do this, it is only necessary to select the compatible grouper pin conveyor assembly.

An example of the foregoing is where the production program of the producer (say the producer noted above) calls for containers of the same diameter, but with different pack patterns, for example, six-to-the-pack and twelve-to-the-pack. The same machine can be employed in conjunction with a single-lane guide assembly, a single belt conveyor, and two pin conveyors. If the program calls for additional patterns, the producer only needs an additional pin assembly for each pattern.

In still another aspect, the invention contemplates that the lane guide assembly and the belt assembly be fixed on the machine with the guide plates and the belts thereof both being manually adjustable while in the installed condition. In connection with the foregoing adjustments, the invention provides several grouper pin assemblies respectively compatible with the lane and the belt spacings.

We claim:

1. In a container-packing machine having main frame means, means on the main frame to accept a supply of containers and direct the containers along an axis together with insert means to receive groups of containers and to insert partition means between containers in a group:

a plurality of independent lane-guide means each alternatively mountable as a unit on said main frame means and removable as a unit from said main frame means, each lane guide means, when mounted on the frame means, to receive containers from said supply and segregate the containers into adjacent spaced-apart lanes and each of the independent lane guide means when mounted on said main frame means effecting different spacing between the lanes for use in accomodating different diameter containers;

means on said main frame forming a main frame opening below the lane guide means installed on the machine;

a plurality of independent belt assemblies each alternatively mountable as a unit within said main frame opening and removable as a unit from the frame opening and each having a plurality of belt means which, when the belt assembly is mounted on the machine, respectively extend along the lanes formed by the lane guide means which is installed on the machine, the belts being for use in moving containers toward said insert means and each independent belt assembly having a grouper pin opening and predetermined spacing between the belt means;

a plurality of independent pin assemblies each alternatively mountable as a unit within the grouper pin opening in any of said belt assemblies and removable as a unit from the grouper pin opening and each pin assembly having a plurality of spaced apart sets of grouper pins each set a plurality of spaced apart grouper pins thereon and when a pin assembly is so mounted, the pins of each set being adapted to respectively engage containers in the lanes and separate the containers into rows normal to the lanes and also to engage containers to separate the containers into groups of containers for said belts to deliver the groups to said insert means and each of the pin assemblies having predetermined spacing between its said sets and predetermined spacing between its said pins; and predetermined combinations (a) of a lane guide means, (b) of a belt assembly, and (c) of a pin assembly being selectable for mounting on the machine to provide for a preselected number of containers in the groups to be moved to the insert means for the insertion of a partition; and first track means on said main frame adjacent said main frame opening and extending normal to said axis;

on each of said belt assemblies, roller means for engaging said first track means and providing for moving its belt assembly into and out of the main frame opening, the first track means and the respective belt assembly roller means providing for said mounting of any of said belt assemblies within said main frame opening and for said removal therefrom;

on each of said belt assemblies, second track means adjacent the grouper pin opening thereof and extending normal to said axis when the belt assembly is mounted in the main frame opening; and on each of said pin assemblies, roller means for engaging said second track means and providing for moving its pin assembly into and out of the grouper pin opening, the second track means and the respective pin assembly roller means providing for said mounting of any of said pin assemblies within the grouper pin opening and for said removal therefrom.

2. In a container packing machine having main frame means, means on the main frame means to accept a supply of containers and direct the containers along an axis together with insert means to receive groups of containers and to insert partition means between containers in a group;

lane guide means removeably mounted on said main frame means and including guide plates to receive containers into adjacent spaced-apart lanes and means mounting the guide plates so that when the lane guide assembly is removed from said main frame means the spacing between the guide plates can be changed for the purpose of accomodating containers of different diameters;

means on said main frame means forming a main frame opening below said lane guide means;

a plurality of independent belt assemblies each alternatively mountable as a unit within said main frame opening and removable as a unit from the frame opening and each having a plurality of belt means which, when the assembly is mounted on the machine, respectively extend along the lanes formed by the lane guide means, the belts being for use in moving containers toward said insert means and each independent belt assembly having predetermined spacing between the belt means and also having a grouper pin opening for receiving a pin assembly;

a plurality of independent pin assemblies each alternatively mountable as a unit within said grouper pin opening and removable as a unit from the group pin opening, each assembly having a plurality of spaced apart sets of grouper pins each with a plurality of spaced apart grouper pins thereon and when a grouper pin conveyor assembly is so mounted, the pins of each set being adapted to respectively engage containers in the lanes and separate the containers into rows normal to the lanes and also to engage containers to separate the containers into the groups of containers for said belts to delivery the groups to said insert means and each of the pin assemblies having predetermined spacing between its said sets and predetermined spacing between its said pins; and predetermined combinations (a) of a lane guide means with desired spacing between guide plates, (b) of a belt assembly, and (c) of a pin conveyor assembly being selectable to provide for a preselected number of containers in the groups to be moved to the insert means for the insertion of a partition;

first track means on said main frame adjacent said main frame opening and extending normal to said axis;

on each of said belt assemblies, roller means for engaging said first track means and providing for moving its belt assembly into and out of the main frame opening, the first track means and the respective belt assembly roller means providing for said mounting of any of said belt assemblies within said main frame opening and for said removal therefrom;

on each of said belt assemblies, second track means adjacent the grouper pin opening thereof and extending normal to said axis when the belt assembly is mounted in the main frame opening; and on each of said pin assemblies, roller means for engaging said second track means and providing for moving its pin assembly into and out of the grouper pin opening, the second track means and the respective pin assembly roller means providing for said mounting of any of said pin assemblies within the grouper pin opening and for said removal therefrom.

3. In a container packing machine including main frame means over which containers and groups of containers are moved along a horizontal axis and insert means disposed along the axis for inserting partition means on said main frame means forming a frame opening adjacent said insert means;

spaced apart frame track means on said main frame means and extending normal to said axis through said frame opening;

belt assembly means including:

grouper belt frame means formed with a grouper pin opening;

first belt sprocket means connected to one side of the grouper belt frame means;

second belt sprocket means connected to the opposite side of the grouper belt frame means;

a plurality of belt guide means disposed on top of said grouper frame means between said first and second sprocket means;

belt idler means connected to the bottom of said grouper belt frame means;

a plurality of endless grouper belts respectively mounted on said belt guide means and engaging said first and second sprocket means and said idler means;

drive means connected with one of said sprocket means for use in rotating the sprocket means and causing movement of the belts along said belt guide means;

a pair of guide means on said grouper belt frame and extending normal to said axis through said grouper pin opening;

means on said grouper belt frame for moving the said guide means vertically within the grouper pin opening;

first roller means respectively on said guide means;

said grouper belt frame means, said sprockets, and said endless grouper belts being configured for the grouper belt conveyor assembly means to fit inside of said frame opening;

second roller means on said grouper belt frame means and mounted on the frame track means of said main frame and providing for the belt assembly means to be moved into and out of said main frame opening whereby the belt assembly means can be mounted on the main frame or removed from the main frame;

pin assembly means including:

grouper pin frame means;

first grouper pin sprocket means rotatably mounted on the grouper pin frame means;

a pair of grouper pin drive sprocket means mounted on said grouper pin frame means for rotation in unison;

a pair of grouper pin idler sprocket means rotatably mounted on said grouper pin frame means;

first and second grouper pin chain means respectively disposed on corresponding drive and idler sprocket means;

drive means connected to said first grouper pin sprocket means to cause rotation thereof and movement of said first and second grouper pin chain means;

a plurality of spaced apart flight bar means respectively connected to said first and second grouper pin chain means for motion therewith;

on each flight bar a plurality of grouper pins;

said grouper pin frame means and said first and second grouper pin sprocket means being configured for the pin assembly means to fit inside of said grouper pin opening on said belt assembly means; and grouper pin track means formed on said grouper pin frame means and being engaged with said first roller means on said guide means and providing for the pin assembly to be moved into and out of said grouper pin opening whereby the pin assembly means can be mounted on the belt assembly means or removed therefrom.

* * * * *